US008616915B2

(12) United States Patent
Funamura

(10) Patent No.: US 8,616,915 B2
(45) Date of Patent: Dec. 31, 2013

(54) WIRE-FREE, UNIBODY JUMPER

(75) Inventor: Joshua Funamura, San Jose, CA (US)

(73) Assignee: Apple Inc., Cupertino, CA (US)

( * ) Notice: Subject to any disclaimer, the term of this patent is extended or adjusted under 35 U.S.C. 154(b) by 49 days.

(21) Appl. No.: 13/249,261

(22) Filed: Sep. 30, 2011

(65) Prior Publication Data

US 2012/0282802 A1 Nov. 8, 2012

Related U.S. Application Data

(60) Provisional application No. 61/481,690, filed on May 2, 2011.

(51) Int. Cl.
*H01R 31/08* (2006.01)

(52) U.S. Cl.
USPC ..... 439/507

(58) Field of Classification Search
USPC ..... 439/507–508, 856–858, 167, 861, 852, 439/787, 723, 352
See application file for complete search history.

(56) References Cited

U.S. PATENT DOCUMENTS

| | | | | |
|---|---|---|---|---|
| 5,274,918 | A * | 1/1994 | Reed | 29/882 |
| 5,707,254 | A * | 1/1998 | Chishima et al. | 439/679 |
| 6,257,910 | B1 * | 7/2001 | Mramor | 439/188 |
| 6,325,666 | B1 * | 12/2001 | Robinson et al. | 439/517 |
| 6,764,356 | B2 * | 7/2004 | Becher et al. | 439/835 |
| 7,168,977 | B2 * | 1/2007 | Reibke et al. | 439/507 |
| 7,425,145 | B2 * | 9/2008 | Ngo | 439/290 |
| 7,559,783 | B2 * | 7/2009 | Ripper et al. | 439/188 |
| 7,559,793 | B1 * | 7/2009 | Zhang et al. | 439/517 |

* cited by examiner

*Primary Examiner* — Jean F Duverne
(74) *Attorney, Agent, or Firm* — Kilpatrick Townsend & Stockton LLP

(57) ABSTRACT

Wire-free, unibody jumpers that may be used with crimp terminals. These jumpers may connect two or more adjacent or nearby crimp terminal openings in a plug housing. One example may provide a jumper that is formed from a single piece of metal or other conductive material. In this example, a form may be stamped from a sheet of metal or other conductive material. A jumper may be made by folding or bending the stamped form. The jumper may then be inserted into two or more adjacent or nearby crimp terminal openings in a crimp terminal plug housing. In various examples, the folding or bending of the stamped form may be done in various ways.

20 Claims, 18 Drawing Sheets

WIRE-FREE, UNIBODY JUMPER

CROSS-REFERENCES TO RELATED APPLICATIONS

This application claims the benefit of U.S. provisional patent application No. 61/481,690, filed May 2, 2011, which is incorporated by reference.

BACKGROUND

The number and types of electronic devices that are commercially available have increased tremendously the past few years, and this increase shows no signs of abating. The functionality that each of these devices packs in has increased as well.

Much of this increased functionality is generated by components, circuits, and other apparatus that may be located on a main logic board, or motherboard, in the device. Additional functionality may be included by inserting additional device components inside a device's housing. These additional device components may connect to the components, circuits, and other apparatus on the main logic board.

The additional device components may connect to the main logic board using wires. For example, these wires may be connected to an additional device component on one end, and a plug on the second end. Specifically, each of these wires may be crimped using a wire crimp. The wire crimps may then be inserted into a crimp terminal pug. The crimp terminal plug may be inserted into a crimp terminal receptacle. The crimp terminal receptacle may be attached to a main logic board. Contacts in the crimp terminal plug may connect and form electrical pathways from the wire crimps to the main logic board.

On occasion, it may be desirable to connect two of the crimp terminal receptacle contacts together. One way of doing this is to use a wire jumper. That is, a wire may be crimped using a crimp on each end. Each end of the wire may then be inserted into a crimp terminal plug, thereby forming the desired connection.

But the use of these wires may provide a connection between a main logic board and an additional device component that has an undesirable appearance. For example, the use of such a wire may make it appear that a design error had been committed, and that a wire jumper had been employed to correct the error. This may provide an undesired, and incorrect, impression to users.

Thus, what is needed are apparatus that may be able to connect two crimp terminal receptacle contacts in a wire-free manner. It may also be desirable that this apparatus be able to be readily manufactured.

SUMMARY

Accordingly, embodiments of the present invention provide wire-free, unibody jumpers that may be used with crimp terminals. These jumpers may connect two or more adjacent or nearby crimp terminal openings in a plug housing.

An illustrative embodiment of the present invention may provide a jumper that is formed from a single piece of metal or other conductive material. In various embodiments of the present invention, a form may be stamped from a sheet of metal or other conductive material. The conductive material may be a copper alloy, such as Cu—Ni—Si, phosphor bronze, Be—Cu, Ti—Cu, or other conductive material. A jumper may be formed by folding or bending the stamped form. The jumper may then be inserted into two or more adjacent or nearby crimp terminal openings in a crimp terminal plug housing.

Once inserted, jumpers according to the present invention may provide an aesthetically pleasing, highly robust and reliable connection between two or more contacts in a crimp terminal receptacle. Specifically, the low-profile provided by embodiments of the present invention may provide an attractive appearance, particularly when compared to a wire jumper. Also, the low profile may provide a connection that may be unlikely to become tangled with wires attaching to a crimp terminal plug, and may be unlikely to become snagged on circuitry and apparatus during assembly. Moreover, these jumpers may be unlikely to be accidently removed or displaced when a device enclosure is opened for maintenance or other reasons.

In various embodiments of the present invention, the folding or bending of the stamped form may be done in various ways. In some embodiments of the present invention, two crimp inserts on the jumper are formed at opposite ends of the stamped form. To bring the two crimp inserts into proximity to each other, the stamped form is bent such that one of the two crimp inserts is moved 180 degrees relative to the other. This brings the two crimp inserts into alignment such that they may be inserted into two or more adjacent or nearby crimp terminal openings in a crimp terminal plug housing.

In other embodiments of the present invention, two crimp inserts on the jumper are formed in parallel in the stamped form. A joining portion between the two crimp inserts is bent 180 degrees such that the two crimp inserts are brought into proximity to each other. This brings the two crimp inserts into a closely-aligned arrangement such that they may be inserted into two or more adjacent or nearby crimp terminal openings in a crimp terminal plug housing. These embodiments may be of particular value when connecting three or more crimp terminal openings.

In other embodiments of the present invention, two crimp inserts on the jumper are again formed in parallel in the stamped form. Each of the crimp inserts are folded back towards each other such that the two crimp inserts are brought into proximity. That is, each of the crimp inserts are folded back 180 degrees towards each other. This brings the two crimp inserts into a closely-aligned arrangement such that they may be inserted into two or more adjacent or nearby crimp terminal openings in a crimp terminal plug housing.

In various embodiments of the present invention, a jumper may connect to receptacle contacts, where the receptacle contacts are at least substantially similar, or the same, as other receptacle contacts in the receptacle. That is, the same or similar receptacle contacts that may connect to a crimp wire may also be used to connect to a jumper according to an embodiment of the present invention. In other embodiments of the present invention, some modification to one or more of the receptacle contacts may be made to provide a connection to a jumper according to an embodiment of the present invention.

In various embodiments of the present invention, a jumper may be inserted into crimp terminal openings, where the crimp terminal openings are at least substantially similar to, or the same as, other crimp terminal openings in the crimp terminal plug. That is, the same or similar crimp terminal openings that may accept a crimp wire may also be used to accept a crimp insert on a jumper according to an embodiment of the present invention. In other embodiments of the present invention, some modification or alteration to one or more of the crimp terminal openings may be made to accept a crimp insert on a jumper according to an embodiment of the present invention. For example, sections of plastic or other non-conductive material may be used to separate crimp wire openings in a plug housing. Some of one or more plastic sections may be altered or modified such that a jumper according to an embodiment of the present invention may be inserted. In some embodiments of the present invention, these modifications may be made to improve the appearance of these jumpers.

The appearance of these jumpers may be further improved in various ways in various embodiments of the present invention. For example, a cap, formed of plastic or other material, may be used. In other embodiments of the present invention, a jumper may be plated such that it has a desirable color or finish. For example, a jumper according to an embodiment of the present invention may be plated with nickel to be black to match a crimp terminal plug. In other embodiments of the present invention, paint, labels, or other layers or films may be used to provide an aesthetically pleasing appearance. These caps, labels, plating, or other layers may enhance the appearance of a jumper, and the jumper and these caps, labels, plating, or other layers may provide a highly robust and reliable connection between two or more contacts in a crimp terminal receptacle.

In various embodiments of the present invention, these jumpers may be used to convey one or more bits of information. For example, a jumper may have two crimp inserts, the two crimp inserts arranged to be inserted into two adjacent or nearby crimp wire openings in a crimp terminal plug. The presence or absence of the jumper may convey one bit of information. In another embodiment of the present invention, a jumper may have three crimp inserts, the three crimp inserts arranged to be inserted into three adjacent or nearby crimp wire openings in a crimp terminal plug. The presence or absence of the jumper may convey one bit of information. Also, jumpers having two crimp inserts may be inserted into two of the three crimp terminal openings in one of three ways. In this way, jumpers according to embodiments of the present invention may be used to convey one of five states. In still other embodiments of the present invention, jumpers having four or more crimp inserts may be used.

These bits, or states, may be used to convey various types of information in various embodiments of the present invention. For example, these bits may convey device type, manufacturer identification information, revision information, device size or capacity, or other information. The information may concern various device components, such as batteries, speakers, control mechanisms, screens, or other device components.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
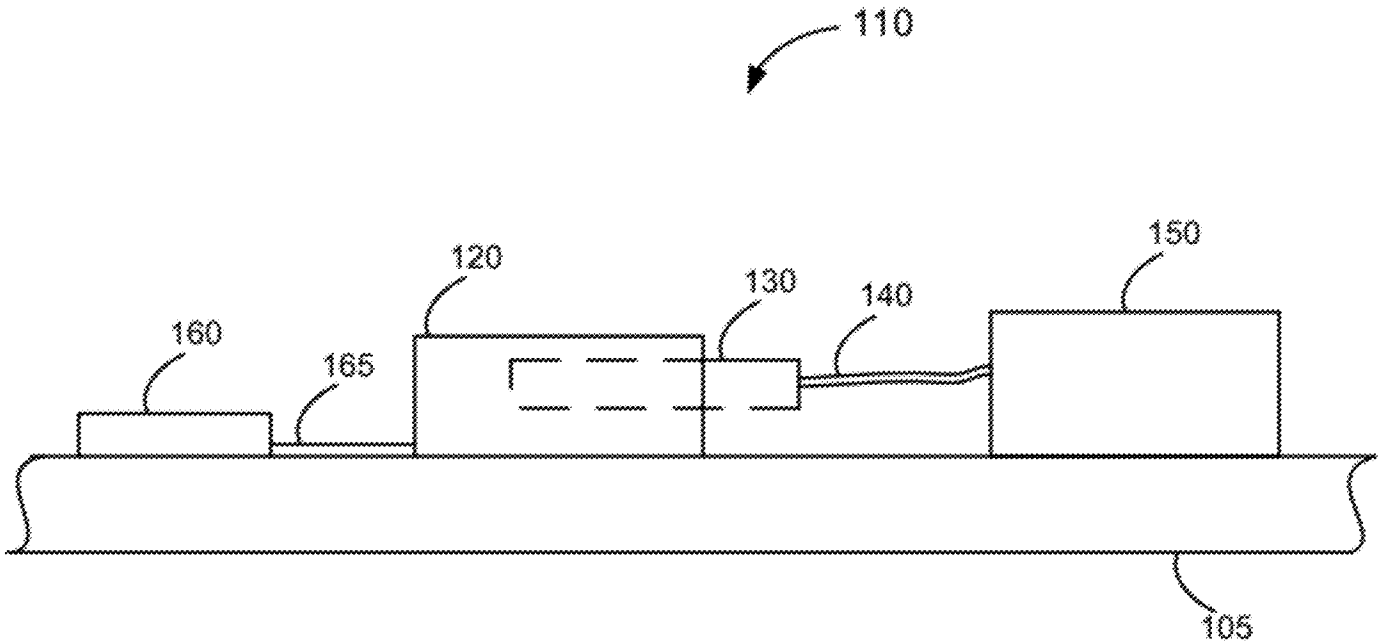
FIG. 1 illustrates a side view of a crimp terminal connector that may be improved by the incorporation of an embodiment of the present invention.

FIG. 1 illustrates a side view of a crimp terminal connector that may be improved by the incorporation of an embodiment of the present invention. This figure, as with the other included figures, is shown for illustrative purposes and does not limit either the possible embodiments of the present invention or the claims.

This figure illustrates a side view of crimp terminal connector 110, which may reside on main logic board 105. Crimp terminal connector 110 may include terminal plug 130 which may be inserted into crimp terminal receptacle 120. Device components 150 may communicate with electronic circuitry 160 via crimp terminal connector 110. Specifically, device component 150 may be connected to wires 140. Wires 140 may have their ends crimped and inserted into openings in crimp terminal plug 130. The crimped ends of wires 140 may connect to contacts (not shown) in crimp terminal receptacle 120. Contacts in crimp terminal receptacle 120 may connect to electronic circuitry 160 via traces 165.

In various embodiments of the present invention, device components 150 may be various types of electronic components. For example, device component 150 may be a battery, speaker, memory module, control device, or other circuit, apparatus, or component. In various embodiments of the present invention, information regarding device component 150 may be conveyed to electronic circuitry, such as electronic circuitry 160. In embodiments of the present invention, this information may be conveyed by the presence or absence of one or more jumpers, which may be inserted into crimp terminal plug 130. These jumpers may provide electrical connections between two or more contacts in crimp terminal receptacle 120. The presence, or absence, of these connections may be used to convey information about device component 150. For example, information such as device type, manufacturer identification information, revision information, device size or capacity, or other information, may be conveyed by the presence or absence of these jumpers. An example of such a jumper and a crimp terminal plug is shown in the following figure.

Figure 2:
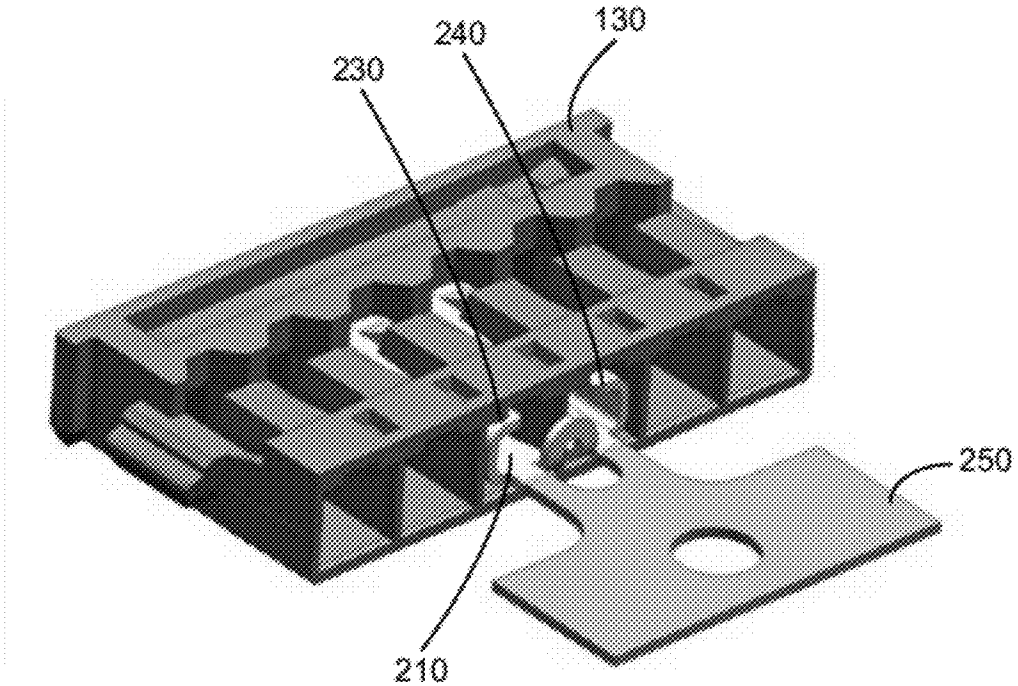
FIG. 2 illustrates a jumper in a crimp terminal plug according to an embodiment of the present invention.

FIG. 2 illustrates a jumper in a crimp terminal plug according to an embodiment of the present invention. In this example, jumper 210 may be located in crimp terminal plug 130. Specifically, jumper 210 may be placed in two openings 230 and 240 in crimp terminal plug 130. In this example, jumper 210 may be placed in two adjacent openings in crimp terminal plug 130. Also in this example, carrier or tab 250 may be attached to jumper 210. After jumper 210 is inserted into crimp terminal plug 130, carrier or tab 250 may be broken off or otherwise removed.

Again, crimp terminal plug 130 may be inserted into crimp terminal receptacle 120. An example is shown in the following figure.

Figure 3:
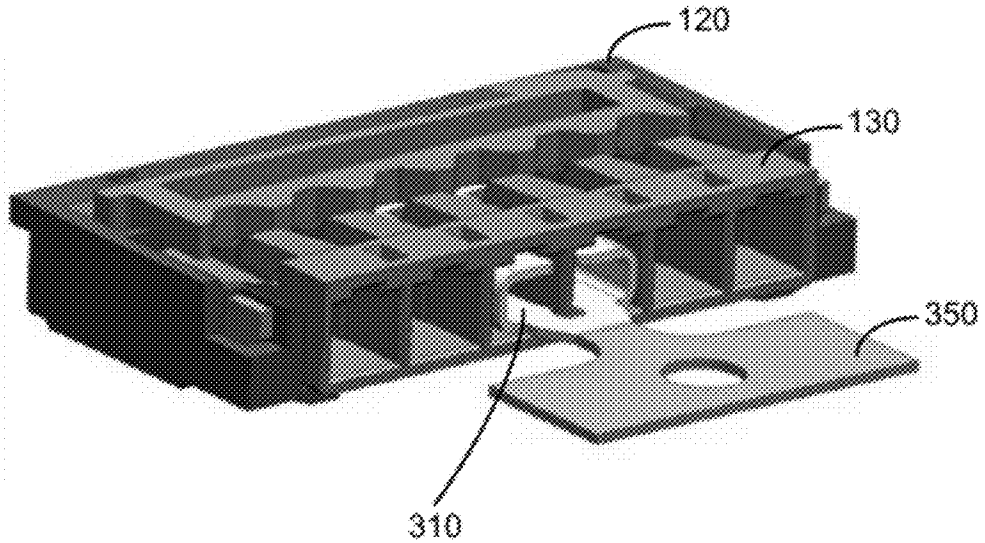
FIG. 3 illustrates a crimp terminal plug inserted in a crimp terminal receptacle.

FIG. 3 illustrates a crimp terminal plug inserted in crimp terminal receptacle. Crimp terminal receptacle 120 may include contacts (not shown), which may connect crimped wires (not shown) and jumper 310 to traces (not shown) on a main logic board.

Embodiments of the present invention may provide jumpers that are easily manufactured. Various embodiments the present invention may achieve this by providing jumpers that are manufactured from a single piece of conductive material, such as a copper alloy. Examples are shown in the following figures.

Figure 4:
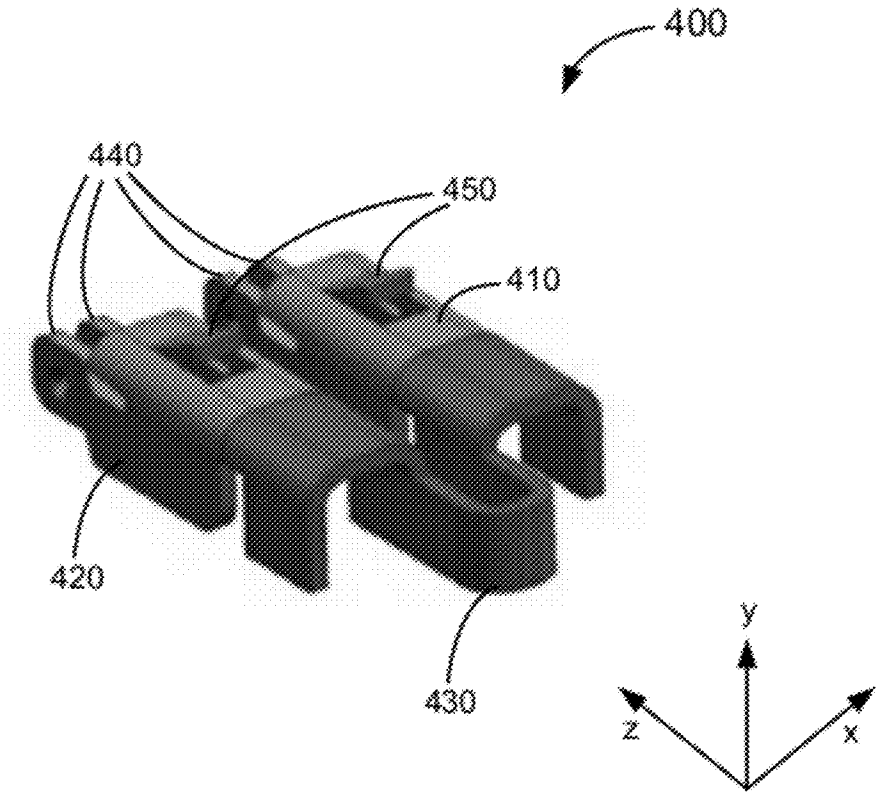
FIG. 4 illustrates a jumper according to an embodiment of the present invention.

FIG. 4 illustrates a jumper according to an embodiment of the present invention. Jumper 400 may include first crimp insert portion 410, second crimp insert portion 420, and joining portion 430. First crimp insert portion 410 and second crimp insert portion 420 may each include contacting terminals 440. Contacting terminals 440 may form electrical connections with contacts in crimp terminal receptacle 120. First crimp insert portion 410 and second crimp insert portion 420 may also include locking tabs 450. Locking tabs 450 may provide protection from accidental removal of jumper 400.

Again, jumper 400 may be manufactured from a single piece of conductive material. The conductive material may be a copper alloy, such as Cu—Ni—Si, phosphor bronze, Be—Cu, Ti—Cu, or other conductive material. Specifically, first crimp insert 410 and second crimp insert 420 may be formed. At this point, first crimp insert 410 and second crimp insert 420 may oppose each other. Joining portion 430 may be bent or folded 180 degrees such that first crimp insert 410 and second crimp insert 420 are brought parallel and in close proximity to each other. By initially forming first crimp insert 410 and a second crimp insert 420, then bending joining portion 430, first crimp insert 410 and second crimp insert 420 may be close enough to fit in adjacent openings in crimp terminal plug 120.

Again, in this embodiments the present invention, jumper 400 may be manufactured by forming first crimp insert 410 and second crimp insert 420 on opposite ends of a piece, then bringing them close together by bending joining portion 430. Other examples of this general method are shown in the following figures.

Figure 5:
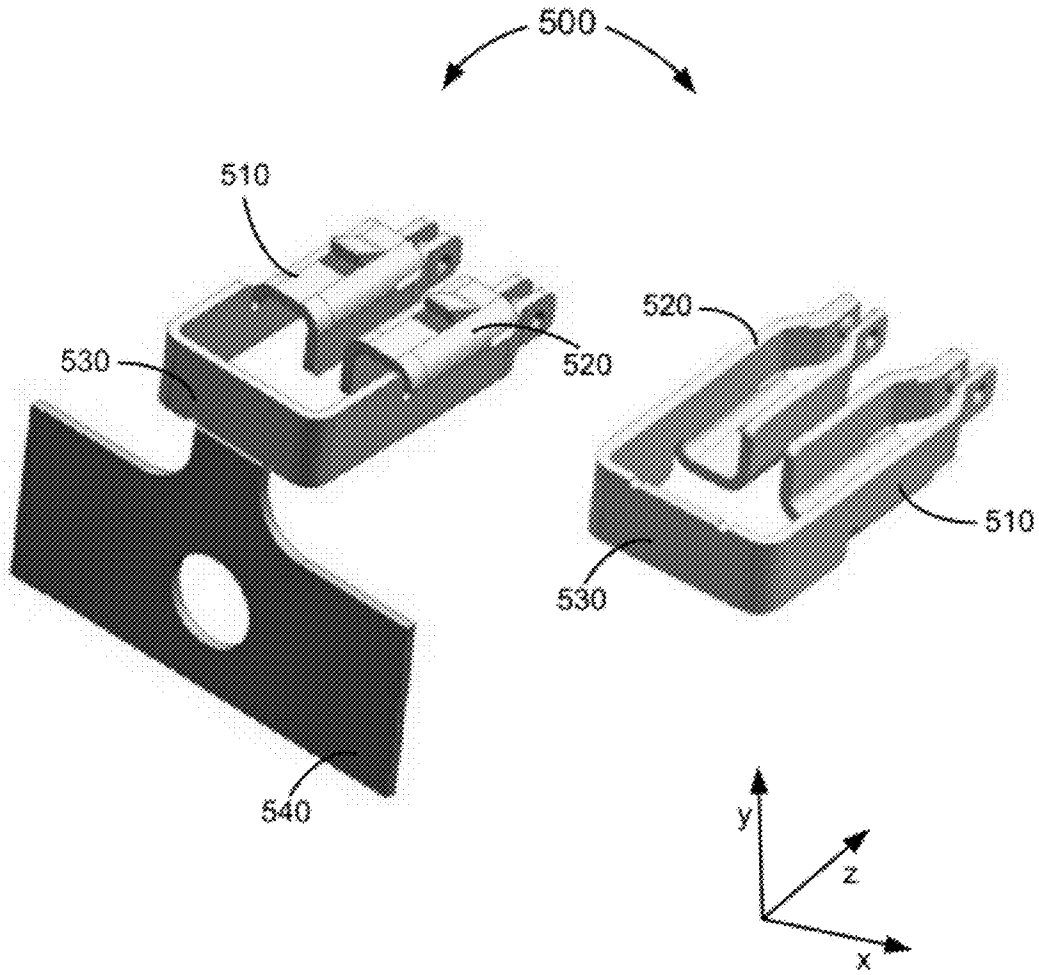
FIG. 5 illustrates another jumper according to an embodiment of the present invention.

FIG. 5 illustrates another jumper according to an embodiment of the present invention. Jumper 500 may include first crimp insert 510, second crimp insert 520, and joining portion 530. In this example, carrier or tab 540 is also included. As before, first crimp insert 510 and second crimp insert 520 may be formed, and then brought into close proximity by bending joining portion 530.

Figure 6A:
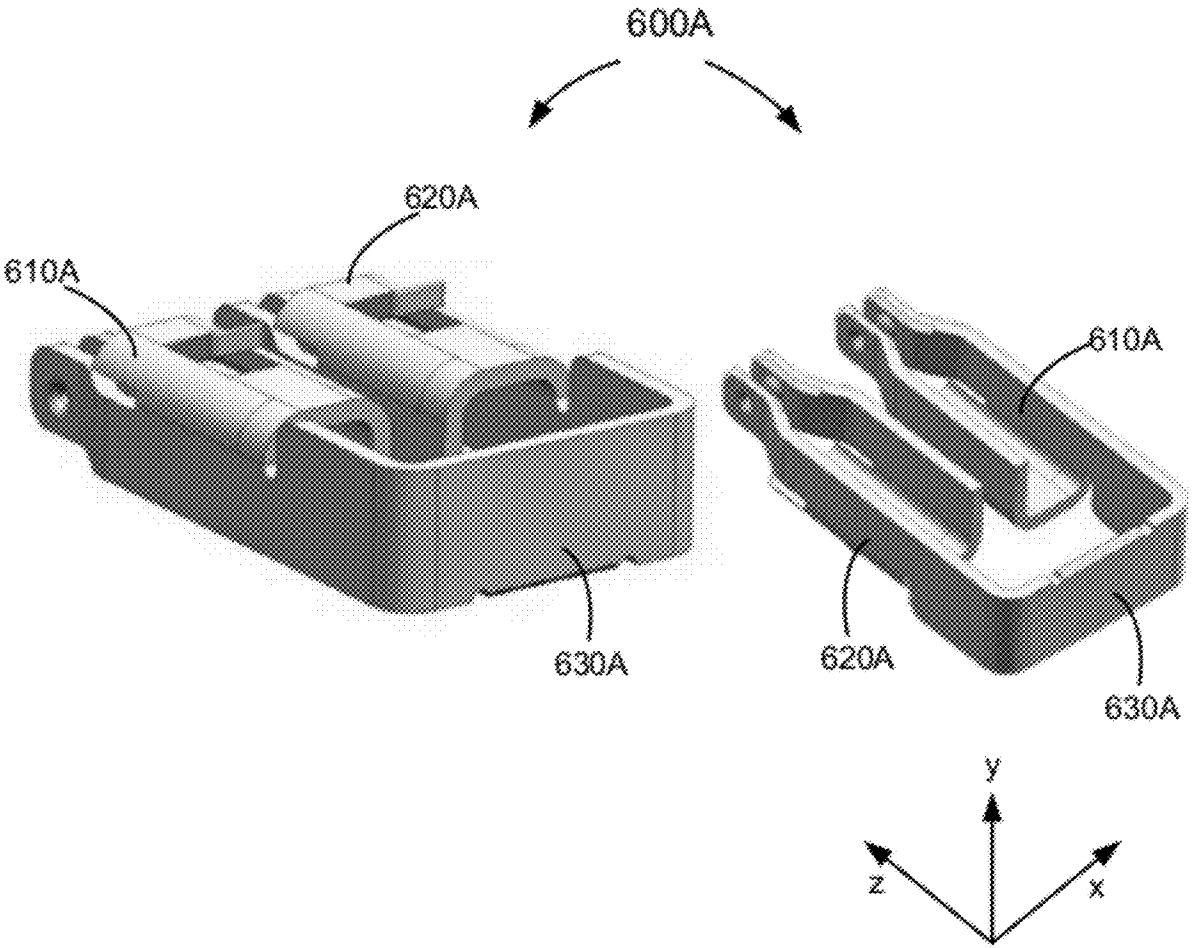
FIG. 6A illustrates another jumper according to an embodiment of the present invention.

FIG. 6A illustrates another jumper according to an embodiment of the present invention. Jumper 600A may include first crimp insert 610A, second crimp insert 620A, and joining portion 630A. As before, first crimp insert 610A and second insert 620A may be formed then brought into close proximity by bending joining portion 630A. Note that jumper 600A may be substantially similar to jumper 500, with the exception that joining portion 630A is closer to first crimp insert 610A and second crimp insert 620A than joining portion 530 is to first crimp insert 510 and second grip insert 520. (That is, joining portion 630A may be shorter than joining portion 530.)

Figure 6B:
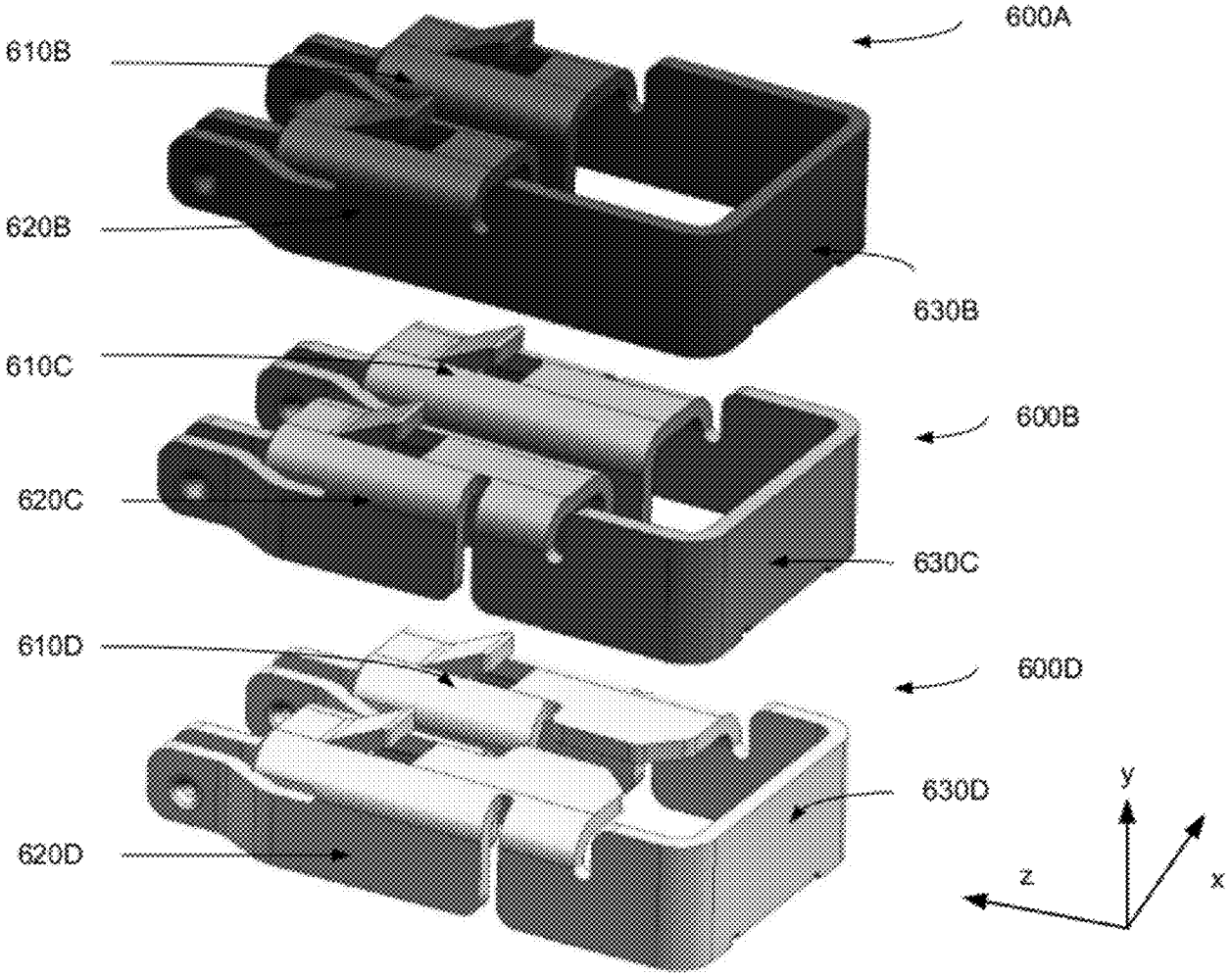
FIG. 6B illustrates variations on the jumper of FIG. 6B according to embodiments of the present invention.

FIG. 6B illustrates variations on the jumper of FIG. 6B according to embodiments of the present invention. As before, each jumper 600B-600D may include first crimp insert 610B-D, second crimp insert 620B-D, and joining portion 630B-D. As before, first crimp insert 610B-D and second insert 620B-D may be formed then brought into close proximity by bending joining portion 630B-D.

In other embodiments of the present invention, the crimp insert portions may be initially formed in parallel, after which a joining portion is folded to bring the crimp inserts into close proximity. An example is shown in the following figure.

Figure 7:
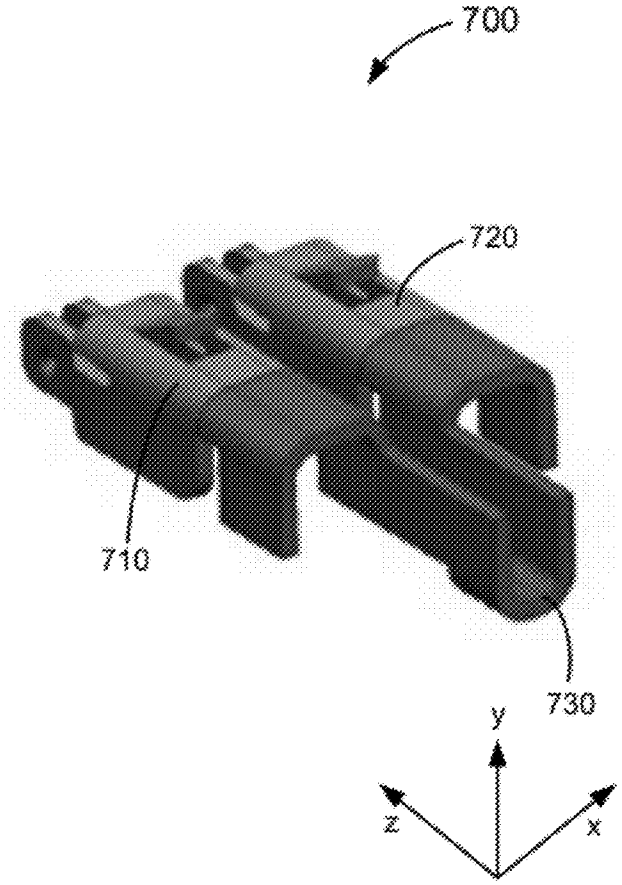
FIG. 7 illustrates another jumper according to an embodiment of the present invention.

FIG. 7 illustrates another jumper according to an embodiment of the present invention. Jumper 700 may include first crimp insert portion 710, second crimp insert portion 720, and joining portion 730. First crimp insert 710 and second group insert 720 may be formed. Joining portion 730 may be folded approximately 180 degrees to bring first crimp insert 710 and second grip insert 730 into close proximity. Once in close proximity, the jumper 700 may be inserted into two adjacent openings in a crimp terminal plug.

In other embodiments of the present invention, the crimp inserts may be folded back towards each other. For example, they may both be folded approximately 180 degrees back towards each other to form a jumper. Examples are shown in the following figures.

Figure 8:
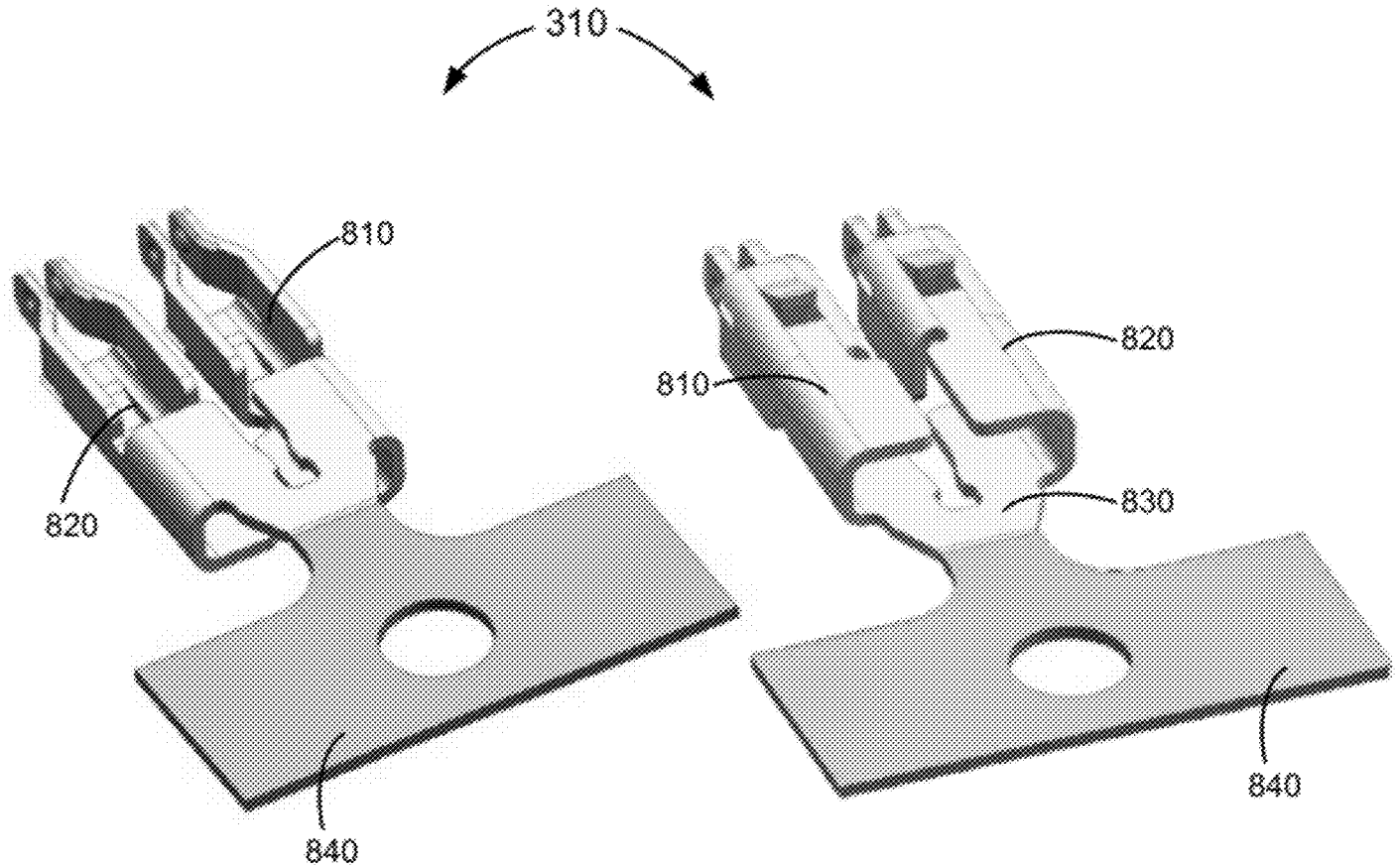
FIG. 8 illustrates another jumper according to an embodiment of the present invention.

FIG. 8 illustrates another jumper according to an embodiment of the present invention. Jumper 310 may include first crimp insert 810, second crimp insert 820, and joining portion 830. Carrier or tab 840 may also be included. Again, first crimp insert 810 and second crimp insert 820 may be folded approximately 180° to be brought into close proximity with each other. Jumper 310 is also shown in crimp terminal plug 130 in FIG. 3.

Figure 9:
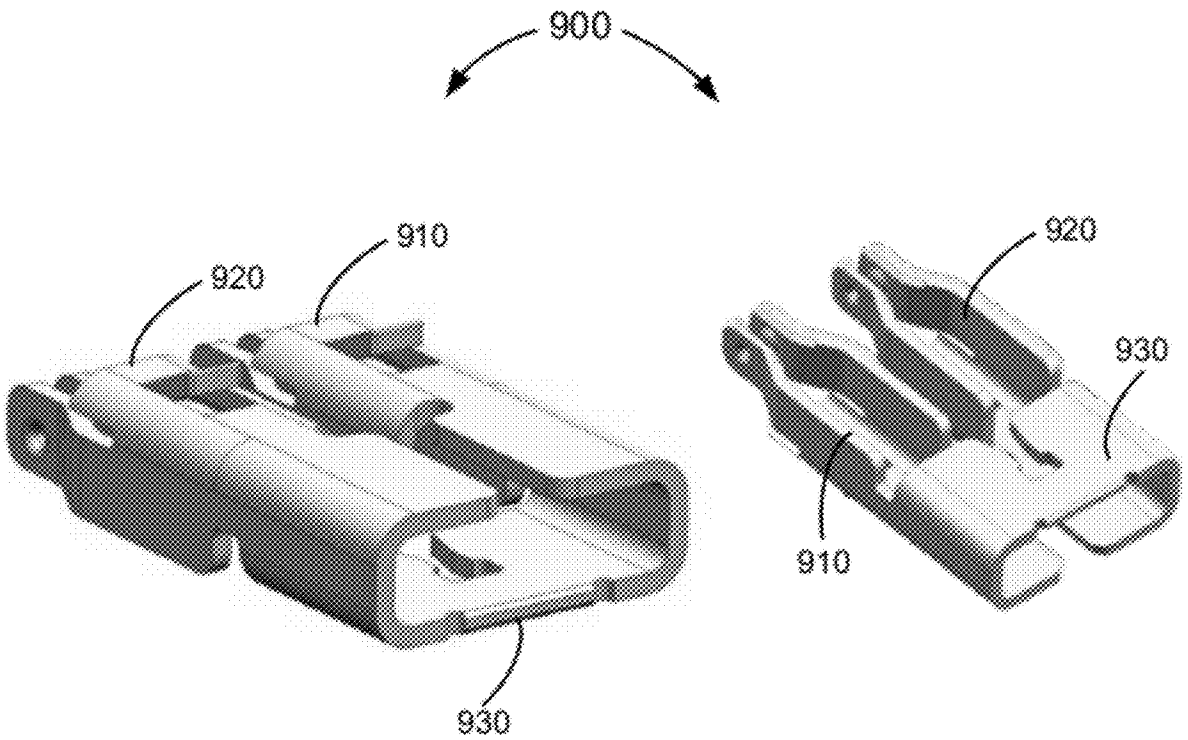
FIG. 9 illustrates another jumper according to an embodiment of the present invention.

FIG. 9 illustrates another jumper according to an embodiment of the present invention. Jumper 900 may include first crimp insert 910, second crimp insert 920, and joining portion 930. Again, first crimp insert 910 and second crimp insert 920 may each be folded approximately 180 degrees to be brought into close proximity with each other.

Figure 10:
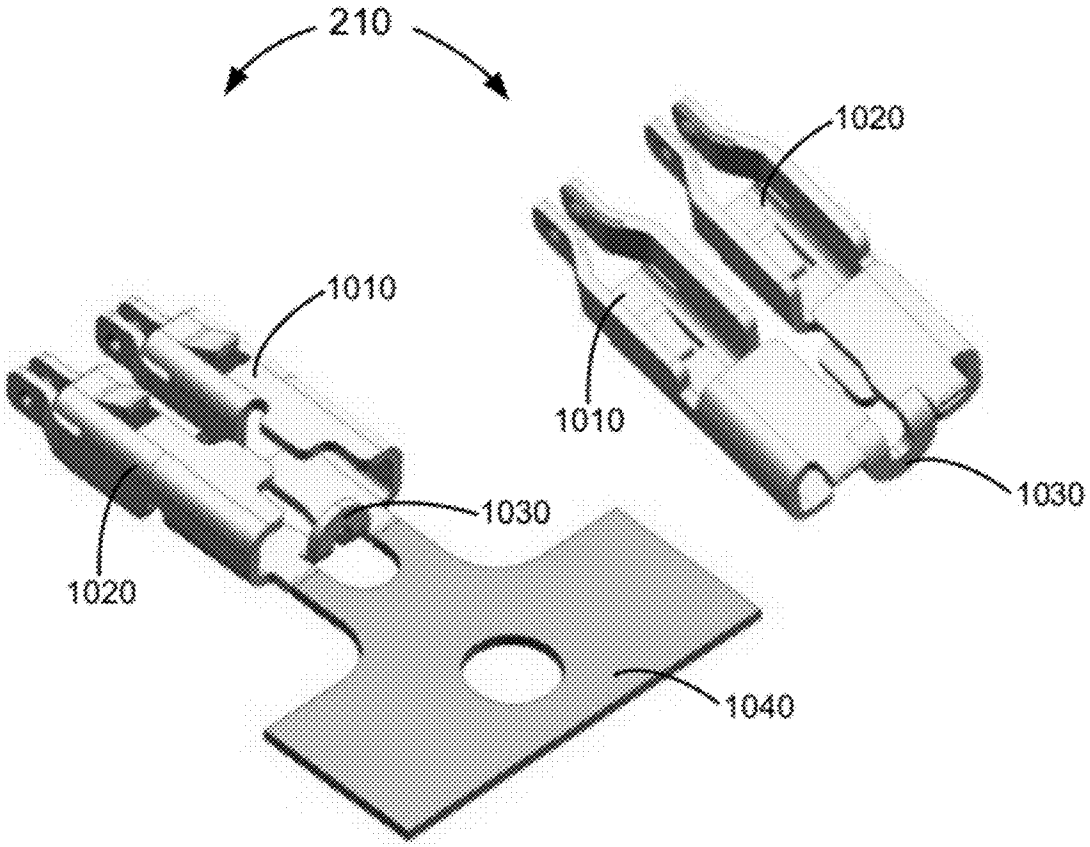
FIG. 10 illustrates another jumper according to an embodiment of the present invention.

FIG. 10 illustrates another jumper according to an embodiment of the present invention. Jumper 210 may include first crimp insert 1010, second crimp insert 1020, and joining portion 1030. Again, first crimp insert 1010 and second crimp insert 1020 may be folded approximately 180 degrees to be brought into close proximity with each other. Carrier or tab 1040 is shown for illustrative purposes. Also, in this example, joining portion 1030 is bent or folded 90 degrees to limit its protrusion from crimp terminal plug 130. Jumper 210 is also shown inserted in crimp terminal plug 130 in FIG. 2.

Again, jumpers according to embodiments of the present invention may be inserted in to two or more openings in a crimp terminal plug. These jumpers may be used to provide an electrical connection between two or more contacts in a crimp terminal receptacle. These jumpers may provide an aesthetic improvement over a conventional wire jumper. These jumpers may also provide a highly robust and reliable connection between two or more contacts in a crimp terminal receptacle. Specifically, the low-profile provided by embodiments of the present invention may provide a connection that may be unlikely to be in the way or, or become tangled with, wires attaching to a crimp terminal plug, and may be unlikely to become snagged on circuitry and apparatus during assembly. Moreover, these jumpers may be unlikely to be accidently removed or displaced when a device enclosure is opened for maintenance or other reasons. An example is shown in the following figure.

Figure 11:
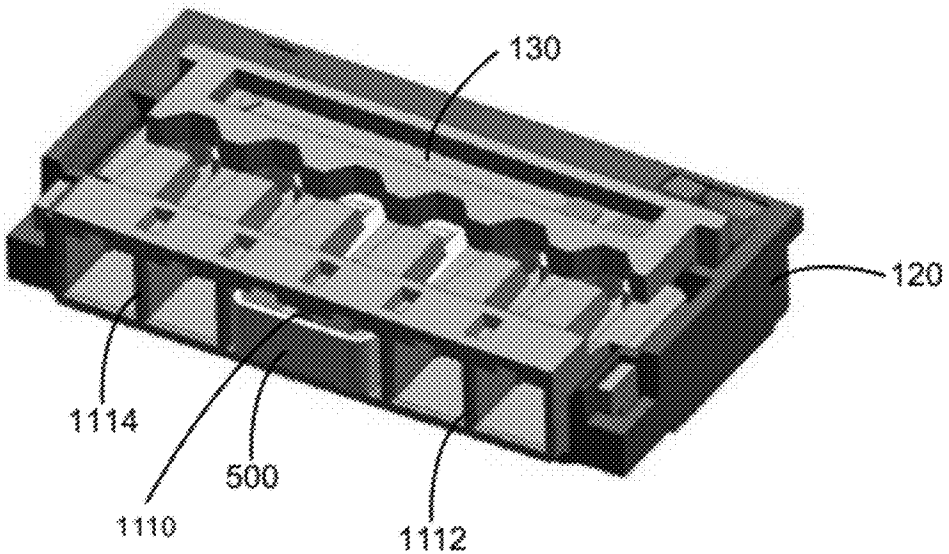
FIG. 11 illustrates a crimp terminal and jumper according to an embodiment of the present invention.

FIG. 11 illustrates a crimp terminal and jumper according to an embodiment of the present invention. In this example, jumper 500 may be inserted into two adjacent openings in crimp terminal plug 130. Crimp terminal plug 130 may be inserted into crimp terminal receptacle 120.

In this example, divider 1110 may be substantially the same or similar to dividers 1112 and 1114. That is, jumper 500 may be configured such that divider 1110 does not need to be different from dividers 1112 and 1114. This may also be true in the example shown in FIG. 2, which shows jumper 210 in crimp terminal plug 130, and in FIG. 3, which shows jumper 310 in crimp terminal plug 130.

In other embodiments of the present invention, a divider, such as divider 1110 that separates openings in crimp terminal plug 130, may be modified or altered as compared to dividers 1112 and 1114. Again, this may enable the use of a lower profile for the jumper (such as jumpers 600 and 900), which may aid in improving and appearance of a jumper and crimp terminal plug combination. Also, this lower profile may aid in preventing the jumper from getting in the way of, or becoming snagged in, wires of the crimp terminal plug or on circuits or apparatus during assembly. Examples are shown in the following figures.

Figure 12:
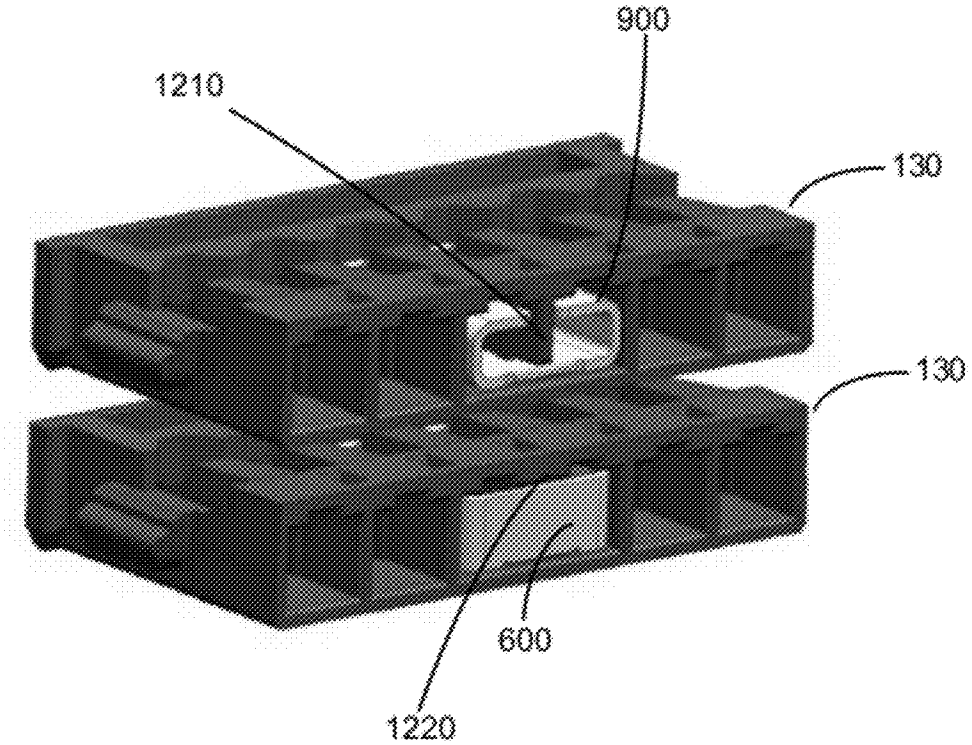
FIG. 12 illustrates two examples of jumpers in crimp terminal plugs according to embodiments of the present invention.

FIG. 12 illustrates two examples of jumpers in crimp terminal plugs according to embodiments of the present invention. In these examples, jumpers 900 and 600 and reside in adjacent openings in crimp terminal plugs 130. In these examples, portions of dividers 1210 and 1220 are not present. This allows jumpers 900 and 600 to aligned flush with rear surfaces of crimp plugs 130.

In various embodiments of the present invention, other steps may be taken to improve the appearance and functionality of jumpers according to embodiments of the present invention. For example, caps, labels, plating, or other films or coatings may be used to improve the appearance of a jumper. In one specific example, some or all of a jumper may be plated to match a color or texture of a crimp terminal plug. These caps, labels, plating, or other layers may enhance the appearance of a jumper, and the jumper and these caps, labels, plating, or other layers may provide a highly robust and reliable connection between two or more contacts in a crimp terminal receptacle. Examples of various caps that may be used to improve the appearance of a jumper according to an embodiment of the present invention are shown in the following figures.

Figure 13:
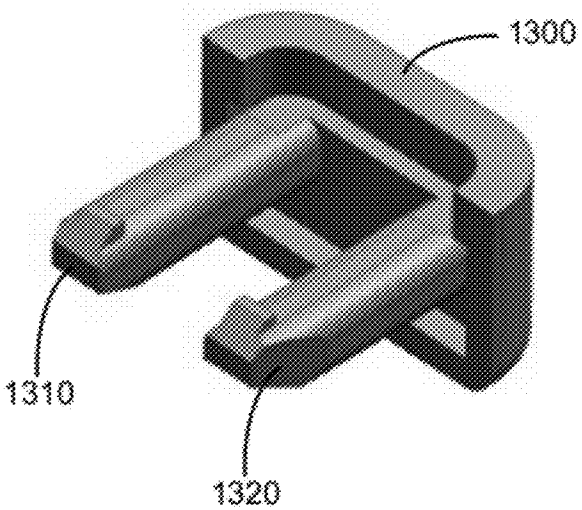
FIG. 13 illustrates a cap that may be used with jumpers according to embodiments the present invention.

FIG. 13 illustrates a cap that may be used with jumpers according to embodiments the present invention. Cap 1300 may include first prong 1310 and second prong 1320. Prongs 1310 and 1320 may be inserted into crimp inserts on a jumper. An example is shown in the following figure.

Figure 14:
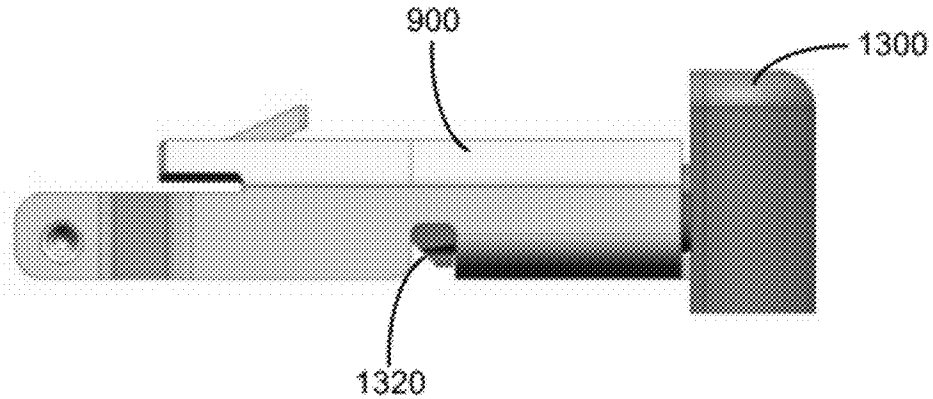
FIG. 14 illustrates a cap inserted into a jumper according to an embodiment of the present invention.

FIG. 14 illustrates a cap inserted into a jumper according to an embodiment of the present invention. Cap 1300 may include locking portion 1320 to provide a secure insertion into jumper 900.

Figure 15:
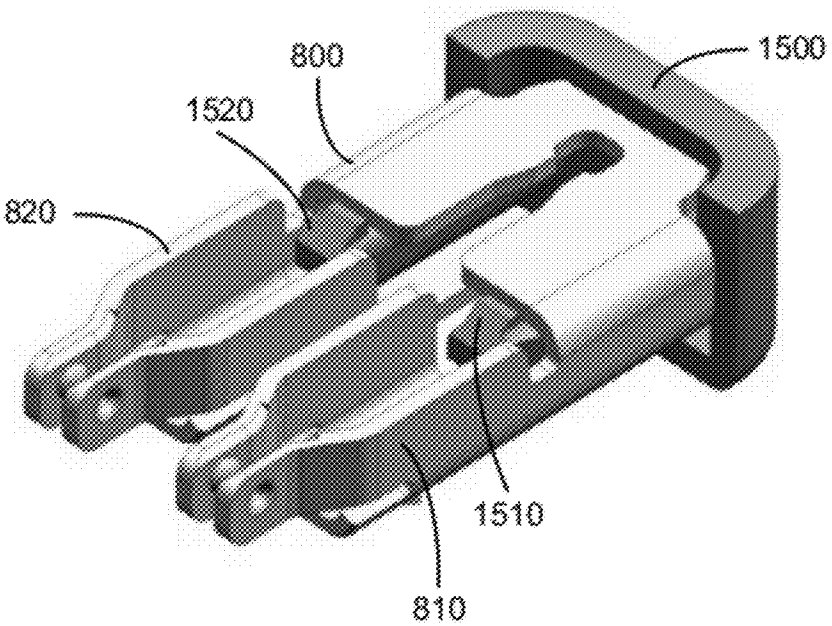
FIG. 15 illustrates another cap inserted into a jumper according to an embodiment of the present invention.

FIG. 15 illustrates another cap inserted into a jumper according to an embodiment of the present invention. In this example, cap 1500 is inserted into jumper 800. The cap and jumper combination may be inserted into a crimp terminal plug. Examples are shown in the following figures.

Figure 16:
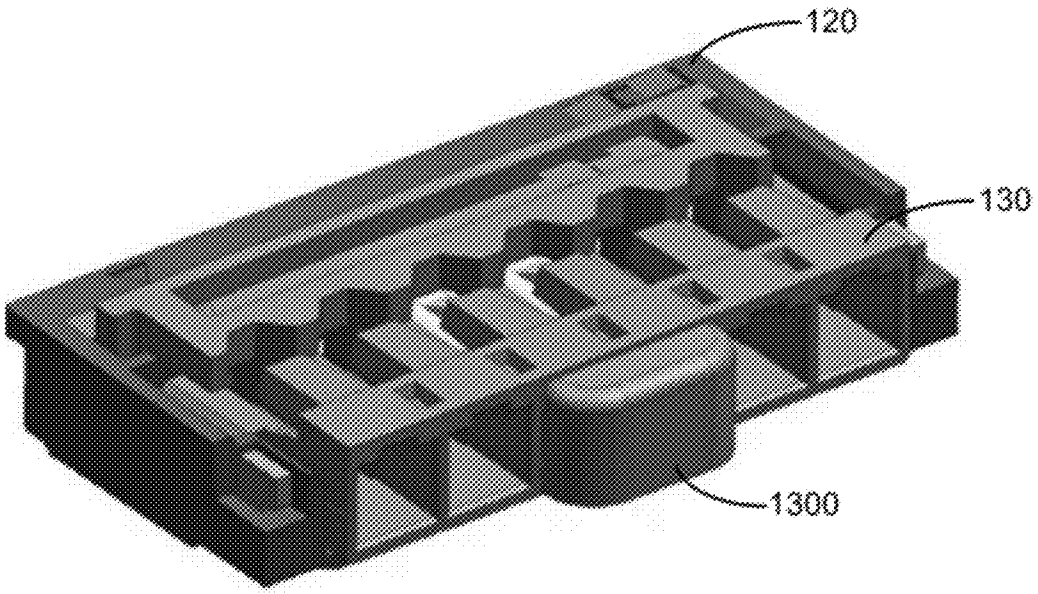
FIG. 16 illustrates a jumper having a cap inserted into crimp terminal plug.

FIG. 16 illustrates a jumper having a cap inserted into crimp terminal plug. As before, crimp terminal plug 130 is further inserted into crimp terminal receptacle 120.

In various embodiments of the present invention, these tabs may have various shapes. For example, a cap may have a shape that is readily grasped by fingers or a tool. An example is shown in the following figure.

Figure 17:
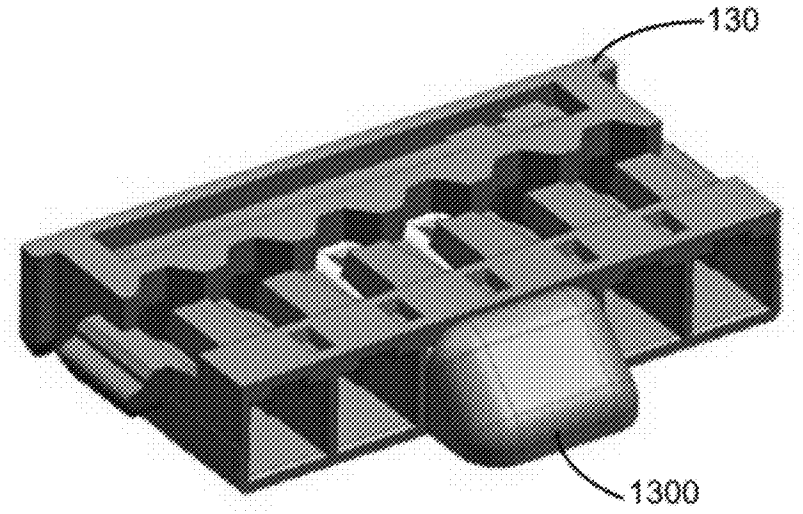
FIG. 17 illustrates a jumper having a cap inserted into a crimp terminal plug according to embodiments the present invention.

FIG. 17 illustrates a jumper having a cap inserted into a crimp terminal plug according to embodiments the present invention. In this example, cap 1700 is inserted into a jumper, which is further inserted into crimp terminal plug 130. In this example, 1700 may be shaped such that it is readily grasped by fingers or a tool.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A jumper comprising:

a single piece of conductive material having a first portion and a second portion, wherein the first portion is folded to form a first crimp insert to be inserted in a first opening in a crimp terminal plug;

the second portion is folded to form a second crimp insert to be inserted in a second opening in a crimp terminal plug, the second opening adjacent to the first opening; and the single piece of conductive material is folded to bring the first portion into proximity with the second portion to form a joining portion joining the first crimp insert and the second crimp insert.

2. The jumper of claim 1 further comprising a cap, the cap having a first tab placed in the first crimp insert.

3. The jumper of claim 2 wherein the cap further has a second tab placed in the second crimp insert.

4. The jumper of claim 1 wherein at least a portion of the joining portion is plated.

5. The jumper of claim 4 wherein the plated portion is plated to match a color of the crimp terminal plug.

6. The jumper of claim 1 wherein the at least a portion of the joining portion is covered by a label.

7. The jumper of claim 1 wherein the crimp terminal plug is arranged to fit in a crimp terminal receptacle.

8. The jumper of claim 7 wherein the first crimp insert comprises a pair of contacting terminals.

9. The jumper of claim 8 wherein the pair of contacting terminals are arranged to mate with a blade contact in a crimp terminal receptacle.

10. A crimp terminal plug comprising:

a plurality of openings separated by housing dividers; and a jumper comprising a single piece of conductive material and comprising:

a first crimp insert inserted in a first opening in the crimp terminal plug, the first crimp insert having a first part, a second part, and a third part, the first and third parts parallel to each other and orthogonal to the second part;

a second crimp insert inserted in a second opening in the crimp terminal plug, second crimp insert having a first part, a second part, and a third part, the first and third parts parallel to each other and orthogonal to the second part; and a joining portion joining the first crimp insert and the second crimp insert, wherein the first opening and the second opening are adjacent openings in the crimp terminal plug.

11. The crimp terminal plug of claim 10 further comprising a cap, the cap having a first tab inserted in the first crimp insert.

12. The crimp terminal plug of claim 10 wherein the cap further has a second tab inserted in the second crimp insert.

13. The crimp terminal plug of claim 10 wherein a housing divider between the first opening and the second opening in the crimp terminal plug is similar to housing dividers between other openings in the crimp terminal plug.

14. The crimp terminal plug of claim 10 wherein a housing divider between the first opening and the second opening in the crimp terminal plug is different than housing dividers between other openings in the crimp terminal plug.

15. A jumper comprising a single piece of conductive material and comprising:

a first crimp insert having a first part, a second part, and a third part, the first and third parts parallel to each other and orthogonal to the second part;

a second crimp insert having a first part, a second part, and a third part, the first and third parts parallel to each other and orthogonal to the second part; and a joining portion joining the first crimp insert and the second crimp insert.

16. The jumper of claim 15 wherein the first crimp insert is arranged to inserted in a first opening in a crimp terminal plug and the second crimp insert is arranged to inserted in a second opening in the crimp terminal plug.

17. The jumper of claim 15 wherein the first crimp insert is formed by folding a first portion of the single piece of conductive material and the second crimp insert is formed by folding a second portion of the single piece of conductive material.

18. The jumper of claim 17 wherein the joining portion is formed by folding the single piece of conductive material to bring the first crimp insert into proximity of the second crimp insert.

19. The jumper of claim 18 wherein the single piece of conductive material is a piece of sheet metal.

20. The jumper of claim 15 further comprising a cap, the cap having a first tab placed in the first crimp insert.

* * * * *